United States Patent [19]

Emmons

[11] 4,137,357

[45] Jan. 30, 1979

[54] PLASTIC THERMOSET LAMINATES

[75] Inventor: Roger D. Emmons, Decorah, Iowa

[73] Assignee: UOP Inc., Des Plaines, Ill.

[21] Appl. No.: 844,664

[22] Filed: Oct. 25, 1977

[51] Int. Cl.[2] ..... B32B 7/00

[52] U.S. Cl. ..... 428/245; 428/257; 428/260

[58] Field of Search ..... 428/289, 290, 260, 245, 428/302, 280, 365, 375, 396, 901, 257, 258, 259

[56] References Cited

U.S. PATENT DOCUMENTS

| | | | |
|---|---|---|---|
| 2,833,283 | 5/1958 | Spahr et al. | 428/289 |
| 2,864,093 | 12/1958 | Sumner et al. | 428/236 |
| 2,940,863 | 6/1960 | Bennett et al. | 428/289 |
| 2,988,416 | 6/1961 | Wood | 428/289 |
| 3,058,849 | 10/1912 | Bakke et al. | 428/260 |
| 3,434,870 | 3/1969 | Tovey et al. | 428/289 |
| 3,706,595 | 12/1972 | Drelich et al. | 428/290 |
| 3,855,047 | 12/1974 | Groff | 428/290 |
| 3,934,067 | 1/1976 | Goldman et al. | 428/290 |

*Primary Examiner*—James J. Bell
*Attorney, Agent, or Firm*—James R. Hoatson, Jr.; Raymond H. Nelson; Page, II William H.

[57] ABSTRACT

High pressure plastic thermoset laminates which possess excellent post-forming characteristics comprise a substrate consisting of a blended fabric which has a thermosetting plastic impregnated therein. The blended fabric itself consists of a mixture of a natural fiber and a thermoplastic material. The laminate is exemplified by a substrate consisting of a cotton-polyester blend having a thermoset phenolic resin impregnated therein.

3 Claims, No Drawings

PLASTIC THERMOSET LAMINATES

This invention relates to high pressure plastic thermoset laminates. More specifically, the invention is concerned with laminates comprising a substrate having a resin impregnated therein, the particular substrate possessing a superior post-forming capability.

Heretofore, the standard base material for a post-forming laminate usually comprised a chafer-style fabric which was woven with all cotton yarns. The cotton yarn which acted as a substrate would then be impregnated with a plastic resin to form a laminate. However, the resulting laminate would not possess a post-forming character which would permit relatively small radius bends. When forming a desired article the laminate is usually prepared in a flat form and the parts of the article were fabricated by punching or machining. When utilizing articles which are not flat in nature but have bends, it may be necessary, in some instances, to manufacture these articles wherein the bend possesses a relatively small radius. For example, when utilizing a laminate in an electric switch box where the laminate is positioned over the place where the hot wires enter the switch box or has a finger guard or in other places where formation of the article by bending is required it may be necessary, as heretofore set forth, to form these articles with relatively small radius bends in the article.

It has now been discovered that a high pressure plastic thermoset laminate which possesses excellent post-forming capabilities may be manufactured by utilizing a substrate consisting of blended fabric which has a thermoset plastic impregnated therein. The blended fabric which is utilized as the substrate consists of a natural fiber combined with a thermoplastic material, the finished laminate possessing the desired capabilities whereby smaller radius bends may be prepared than those which could be obtained when utilizing the present thermoset post-forming material.

It is therefore an object of this invention to provide a high pressure plastic thermoset laminate which will permit the manufacture of articles which possess relatively small radius bends.

In one aspect an embodiment of this invention resides in a high pressure plastic thermoset laminate comprising a substrate consisting of a blended fabric, said substrate having a thermosetting plastic impregnated therein.

A specific embodiment of this invention is found in a high pressure plastic thermoset laminate comprising a substrate consisting of a blended fabric, said blended fabric consisting of a natural fiber such as cotton combined with a thermoplastic material such as a polyester, the substrate being impregnated with a phenol-formaldehyde resin.

Other objects and embodiments will be found in the following detailed description of the present invention.

As hereinbefore set forth the present invention is concerned with a high pressure plastic thermoset laminate comprising a base material or substrate consisting of a blend of a natural fiber and a thermoplastic material, said base material being impregnated with a thermoset resin. By utilizing a base material or substrate or a blended fabric, it is possible to permit the post-forming of material which is of a larger nominal thickness than is the material which is currently available for post-forming laminates. The present National Electrical Manufacturers Association (NEMA) maximum nominal thickness is 0.250 inches. In contrast to this, by utilizing the novel post-forming laminate base material of the present invention which is impregnated with a thermoset resin, it will be possible to post-form material which possesses a nominal thickness of 0.50 inches.

The base material or substrate of the post-forming laminate of the present invention will comprise a chafer-style blended fabric consisting of a combination of a natural fiber and a thermoplastic material. In the preferred embodiment of the invention the natural fiber will comprise a cotton yarn although it is also contemplated within the scope of this invention that other material fibers such as wool or linen may also be employed, although not necessarily with equivalent results. The thermoplastic material which is blended with the natural fiber will comprise resins such as polyester resins. These polyester resins are usually produced by the reaction of a dibasic acid with a dihydric alcohol. For example, polyester resins may be prepared by reacting an unsaturated dibasic acid or anhydride thereof such as maleic acid, maleic anhydride, fumaric acid, glutaconic acid, citraconic acid, etc., with dihydric alcohols such as ethylene glycol, propylene glycol, diethylene glycol, dipropylene glycol, etc. If the dibasic acid is saturated in nature, the acid may comprise acids such as oxalic acid, malonic acid, succinic acid, glutaric acid, adipic acid, pimelic acid, azelaic acid, phthalic acid, phthalic anhydride, etc. If so desired, the unsaturated polyester resins may also be further polymerized through cross-linking by adding a second unsaturated monomer such as styrene. While in the preferred embodiment of the invention the thermoplastic material comprises a polyester, it is also contemplated within the scope of this invention that other thermoplastic resins may also be blended with a natural fiber, such thermoplastic materials including the various nylons such as nylon 4, nylon 11, nylon 6, nylon 66, nylon 7, nylon 8, nylon 9, nylon 610, etc.; polyethylenes, polypropylenes, etc. The substrate may be prepared or woven in any manner known in the art, the natural fiber and thermoplastic material being present in the finished blended fabric in any ratio of fabric to material desired. For example, typical base materials which may be employed to form the laminate of the present invention being a 50% cotton yarn/50% polyester material, 50% cotton yarn/50% nylon material, or variations thereof in which the percentage of cotton to thermoplastic material being in an excess or vice versa.

The thermoset resin which is impregnated in the base material will comprise a thermoset plastic resin which will include amino resin type materials which are produced by the reacton of formaldehyde with amino compounds such as urea-formaldehyde, melamine-formaldehyde, aniline-formaldehyde, ethylene urea-formaldehyde, benzoguanamine-formaldehyde, or phenol-formaldehyde resins. It is to be understood that the aforementioned thermoplastic materials and thermoset resins are only representative of the class of compounds which may be employed, and that the present invention is not necessarily limited thereto.

The high pressure plastic thermoset laminates of the present invention are prepared by subjecting the base material which, as hereinbefore set forth, comprises a blended fabric of a natural fiber combined with a thermoplastic material to an impregnation step in which the base material or substrate is thoroughly impregnated with the thermoset resin. The impregnation is effected by passing the base material such as a chafer-style fiber woven with 50% cotton yarn and 50% polyester through a bath of the liquid thermoset resin such as a phenol-formaldehyde resin. After passage through the resin bath the impregnated cloth is then passed through metering rolls whereby the excess resin is squeezed out of the cloth. Thereafter the impregnated cloth is then passed through a drying oven at a temperature of from about 80° C. to about 160° C. wherein the thermoset resin enters a semi-cure state. The impregnated cloth is then cut to size and collated into the particular thickness which is desired for the article. The article may consist of any number of plies ranging from 1 up to about 40. After collating into the desired thickness the laminate is then cured in a laminating press between stainless steel caul plates using a pressure which may range from about 500 to about 2000 pounds per square inch at an elevated temperature which may range from about 300° to about 400° F. After subjecting the laminate to this cure it may then be formed into any desired shape including shapes wherein the bends may be of a smaller radius than was possible to form using laminates which are prepared according to standard procedures.

The following example is given to illustrate the superior postformability impact strength and electrical insulation properties of the high pressure plastic thermoset laminate of the present invention. However, it is to be understood that this example is given merely for purposes of illustration and that the present invention is not necessarily limited thereto.

EXAMPLE I

In this example a chafer-style fabric which was woven with 50% cotton yarn/50% polyester was impregnated with a phenol-formaldehyde resin sold by Union Carbide and known in the trade at 3551 resin. Five pounds of the blended fabric was treated with 5 pounds of resin. The fabric was passed through a solution of the resin at a temperature of 22° C. Following this the material was run through metering rolls to squeeze out the excess resin and pass through a 4 zone drying oven in which zone 1 was maintained at a temperature of 99° C., zone 2 at a temperature of 110° C., zone 3 at a temperature of 132° C. and zone 4 at a temperature of 149° C. for a period of 5 minutes in order to semi-cure the resin. The resin containing substrate was then collated to form a laminate of varying thickness. Sample 1 was 0.04 inches (3/64) thick, sample 2 was 0.062 inches (1/16) thick and sample 3 was 0.187 inches (3/16) thick. Thereafter the samples were cured in a laminating press between stainless steel caul plates at a temperature of 320° F. and a pressure of 1000 pounds per square inch.

A control article which was used to compare with the laminate of the present invention was prepared in a similar manner using an all-cotton base material as the substrate. The cotton which was woven in a chafer-style was treated with a similar phenol-formaldehyde resin under similar conditions to those hereinbefore set forth to prepare three samples of varying thickness. Sample 4 was 0.04 inches thick, sample 5 was 0.062 inches thick and sample 6 was 0.187 inches thick.

The three control samples and the three samples of the high pressure plastic thermoset laminate of the present invention were subjected to various comparative tests. The first test was performed in which a post-forming test used a 3/32 inches radius die on all samples. This test was run as follows: Six test specimens 2 inches × 6 inches in size were obtained. Three of the specimens were cut from sheets of the laminate in the longitudinal direction and three in the transverse direction. The test specimens were then heated in a forced-circulation type of air oven which was maintained at a temperature ranging from 475° F. to 525° F. utilizing wooden or cast resin forms in which the male form had a radius which ranged from 1/32 to 7/16 inches. The samples were heated for a time ranging from about 20 to about 160 seconds following which the test specimens were bent through an angle of 90° between the forms and allowed to cool in the forms. The material which would be considered acceptable is that which bends successfully anywhere between 475° F. with the minimum heating time for the particular thickness and 525° F. with the maximum heating time. In addition after being removed from the form the specimen should retain an angle of not over 93°. The results of this test are set forth in Table I below:

TABLE I

| Sample | Required Value | Test Value |
|---|---|---|
| 1 | 30 seconds at 475° C. | Pass |
| 2 | 50 seconds at 475° C. | Pass |
| 3 | 180 seconds at 475° C. | Pass |
| 4 | 40 seconds at 475° C. | Pass |
| 5 | 65 seconds at 475° C. | Pass |
| 6 | — | Fail |

In the second test the dimensional stability after post-forming was performed as follows: The formed specimens which were obtained from the post-forming test were immersed in water having a temperature of 180° F. ± 2° F. After being immersed for 1 hour the specimens were removed from the water and allowed to cool without being restrained in any way. In order to pass the dimensional stability test the springback should not exceed certain values such as 32° springback for specimens 1/32 inches in thickness, 27° for specimens 3/64 inches in thickness, 25° for specimens 1/16 inches in thickness, 20° for specimens 3/32 inches in thickness, 15° for specimens 1/8 inches in thickness, 12° for specimens 5/32 inches in thickness, 9° for specimens 3/16 inches in thickness, etc. The results of this test are set forth in Table II below:

TABLE II

| Sample | Required Value | Test Value |
|---|---|---|
| 1 | 27° maximum | 23° |
| 2 | 25° maximum | 19° |
| 3 | 9° maximum | 3° |
| 4 | 27° maximum | 23° |
| 5 | 25° maximum | 14° |

Sample 6 failed the post-forming and therefore the dimensional stability test was not performed. It is to be noted from the above table that sample 3 which was prepared according to the present invention and which was the thickest sample possessed an excellent dimensional stability, the test value being only one-third of the allowability maximum degree of spring-back.

To illustrate the relative ability of the laminates of the present invention to withstand flammability conditions a control sample which was 0.062 inches thick and a sample of the laminate of the present invention which possessed the same thickness were ignited and then extinguished. The afterglow in seconds were tested at 107° C. The control sample had a test value of 313.7 seconds while the sample of the laminate of the present invention had an afterglow of 9.3 seconds. This indicated that the laminate of the present invention would extinguish in a relatively short period of time as compared to the control sample in which the substrate consisted of an all-cotton fabric.

Another test was performed in which the impact strength of the laminate was determined. The cantilever beam test was performed in which the specimen which was notched to produce a standard degree of stress concentration was held as a cantilever beam in a vertical position and was broken by a blow delivered at a fixed distance from the edge of the specimen clamp. The apparatus utilized for the test was pendulum type impact machine of rigid construction in which the dimensions of the machine were arranged so that the center of the percussion of the striker was at the point of impact which is the center of the striking edge. The pendulum was released from such a position so that the linear velocity of the striking edge, a circular surface with a horizontal axis, which is the center of the percussion at the instant of the impact was approximately 11 feet per second. In addition, means were provided for clamping the specimen originally in position with the edges of the supporting surface at an angle of 90° C. The apparatus was also provided with means for determining the impact value of the specimen (the energy expended by the machine in breaking the specimen), said value being equal to the difference between the energy in the pendulum blow and the energy remaining in the pendulum after breaking the specimen, suitable corrections being made for windage and friction.

The specimens which were utilized for this test were cut from the laminate sheet in both lengthwise and transverse directions. The test specimens of varying thickness were notched on a milling machine so as to produce a notch in which the included angle was 45° with a radius of curvature at the apex of about 0.01 inches. The test specimen was rigidly clamped with the center line of the notch on the level of the top of the clamping surface and the blow was struck on the notch side. The value of the energy expended in breaking each individual specimen is expressed in foot pound per inch of notch and was determined by dividing the energy and foot pound expended in the individual test by the actual dimension in inches along the notch of the specimen broken in each test. The results of this test are set forth in Table III below:

TABLE III

| Sample | Required Value | Test Value |
|---|---|---|
| 2 | LW 1.5 | 3.366 |
| | CW 1.5 | 2.612 |
| 5 | LW 1.5 | 2.133 |
| | CW 1.5 | 2.055 |

Other tests including flextural strength in pound per square inch showed that both samples possessed passing strengths as well as shear strengths and compressive strengths. When the electric strength was measured in volts/mil the sample in which the substrate consisted of an all-cotton fabric shorted before a reading could be made, while the sample prepared according to the present invention did not.

From the above tests it is readily apparent that samples of high pressure plastic thermoset laminates in which the substrate or base material comprised a blended fabric of a natural fiber and a thermoplastic resin possessed superior post-formability, impact strength and electrical insulation properties when compared to a laminate which was manufactured according to the standard industrial practices, the base material for the laminate consisting of a chafer-style fabric which was woven from all-cotton yarns.

I claim as my invention:

1. A high pressure plastic thermoset post-forming laminate consisting essentially of a blended fabric substrate consisting of natural cotton fibers woven with polyester wherein said substrate has a phenol-formaldehyde resin impregnated therein.

2. The post-forming laminate of claim 1 wherein the cotton fibers and polyester are present in a 1:1 ratio.

3. The laminate as set forth in claim 1 in which said polyester is an unsaturated polyester resin.

* * * * *